United States Patent [19]

Merendino et al.

[11] Patent Number: 4,972,629

[45] Date of Patent: Nov. 27, 1990

[54] REMOTE CONTROLLED OPENING DEVICE

[75] Inventors: Paul A. Merendino, Mogadore; Fred I. Albrecht, Akron, both of Ohio

[73] Assignee: Albrecht, Inc., Akron, Ohio

[21] Appl. No.: 394,561

[22] Filed: Aug. 16, 1989

[51] Int. Cl.[5] ..... E05F 15/20

[52] U.S. Cl. ..... 49/25; 49/28; 49/30; 49/138; 49/340; 49/345; 49/357

[58] Field of Search ..... 49/25, 29, 28, 30, 31, 49/138, 340, 339, 346, 345, 357

[56] References Cited

U.S. PATENT DOCUMENTS

| | | | |
|---|---|---|---|
| 1,269,545 | 6/1918 | Mengedoht | 49/340 |
| 3,084,927 | 4/1963 | Linder | 49/340 X |
| 3,500,585 | 3/1970 | Vollmar | 49/340 X |
| 3,908,309 | 9/1975 | Coulter et al. | 49/31 |
| 4,367,610 | 1/1983 | Goode | 49/340 X |
| 4,658,543 | 4/1987 | Carr | 49/25 X |
| 4,658,545 | 4/1987 | Ingham et al. | 49/340 |
| 4,713,545 | 12/1987 | Norrgren et al. | 49/25 X |
| 4,713,910 | 12/1987 | Quante | 49/25 X |
| 4,727,679 | 3/1988 | Kornbrekke et al. | 49/340 X |
| 4,750,118 | 6/1988 | Heitschel et al. | 49/25 X |

*Primary Examiner*—Philip C. Kannan

*Attorney, Agent, or Firm*—Oldham & Oldham Co.

[57] ABSTRACT

The invention relates to an automatic remote controlled opening device which may be used to open and close doors, windows or similar closure systems. The opening device includes a receiver to detect control signals generated at a remote location from the device. The control signals are then utilized to effect selective operation of a mechanical system coupled with the closure system for opening and closing thereof. The mechanical system enables smooth and efficient automatic opening and closing, but does not inhibit manual operation of the door or the like. Control circuitry associated with the device enables various functions to be performed for selective operation of the device. The device may also be provided with a stored energy source of power such that it can be retrofit for use with an existing closure system. Auxiliary control of the device enables opening or closing in response to an emergency situation or other circumstances.

15 Claims, 4 Drawing Sheets

REMOTE CONTROLLED OPENING DEVICE

BACKGROUND OF THE INVENTION

The present invention is directed to an automatic opening device which may be controlled from a remote location in response to a signal generated from a signal generating means or one or more remotely located sensing devices used to generate remote signals. More particularly, the present invention is directed to an opening device which may be remote controlled and which includes means by which operation of the door can be selectively controlled to determine proper operation of the door upon actuation from a remote location.

There are known door opening devices such as utilized in conjunction with automobiles or the like, which operate to automatically open or close a door or window of an automobile upon activation from a signal generated at a remote location from the door. One example is found in U.S. Pat. No. 4,458,446 disclosing a system by which the door of an automobile cannot be opened or will automatically be closed where an obstruction is located in a region within the vicinity of the door for safety purposes. Another system is shown in U.S. Pat. No. 4,183,177 is directed to an automobile door opening apparatus having means by which the automobile door can be unlocked and unlatched when a control signal remote from the vehicle is detected by a control means fixed to the vehicle.

There are also other systems which provide remotely controlled closures such as found in U.S. Pat. No. 3,337,992 which is applicable for windows, doors and the like wherein a remote sensing device is utilized to actuate a mechanical door opening or closure system in response to various selected physical conditions or other criteria. This system includes programming means to control the overall operation of the system enabling various functions to be selectively achieved. The system is complicated and cumbersome to utilize effectively, and may be prone to breakdown and inefficient operation. Another system for opening and closing windows is shown in U.S. Pat. No. 3,257,757 utilizing vacuum pressure to affect opening and closing of the windows upon activation from a device coupled to the system as a remote location other systems are found in U.S. Pat. Nos. 4,660,324, and 4,598,494.

In the prior art, there has been found a need to provide a remote controlled opening and closing device for closure systems such as doors, windows and the like which will effectively operate to open or close the door or other device regardless of conditions which may exist which would inhibit operation of other known devices such as power outages, fires or similar occurrences. Additionally, it is desired that the remote control opening and closing device be easily installed so as to enable retrofitting to an existing door or window structure or which can be easily incorporated into a new construction. The device should be easily operated from a remote location by means of control signals sent from a hand held remote device having means to accommodate a variety of control signals to prevent accidental opening or closing from occurring based upon control signals generated from another remote device. It is also desired that the opening and closing system operate efficiently and over an extended period of time in a quiet and constant manner while being cost effective and convenient to use.

SUMMARY OF THE INVENTION

Based upon the foregoing, it is a main object of the present invention to provide a remote control opening and closing device which allows efficient and extended operation to automatically open or close a door, window or other closure system for an extended period of time.

Another object of the invention is to provide an opening and closing device which can be operated from a hand-held remote signal generating device preferably generating infrared control signals utilized by the opening and closing device to effect operation thereof. With such a system, the capabilities are expanded as a large number independent frequency channels may be provided for operation of individual doors, windows or other closure devices. Similarly, the system may be tuned so as to avoid interference from outside sources of signals which may induce accidental opening or closing of the closure devices.

It is yet another object of the invention to provide an auxiliary input for master control of all opening and closing devices regardless of the frequency at which they are tuned or external sources which may effect operation thereof making the system especially useful for emergency situations allowing safe exit through doors, windows or the like.

Another object of the invention is to provide an opening and closing system wherein the system is battery operated or includes a back up system for effective operation of the system regardless of power outages or other external variables which may inhibit operation of the system otherwise. Additionally, the system is provided with means by which battery power may be conserved so as to extend the useful life of the battery and reduce the necessity of recharging the batteries except at relatively long intervals during use of the system.

It is yet another object of the invention to provide an opening and closing system which is easily installed on existing door, window or the frames thereof for retrofitting the system easily and conveniently. Alternatively, the system can be mounted within a door frame or window frame during construction so as to incorporate the system easily into the new construction for use therewith.

These and other objects of the invention are accomplished by an opening and closing system comprising a small light weight mechanical system which will operate to smoothly and effectively open and close a closure device upon actuation from a remote location. The mechanical system includes a DC motor generating a desired drive output which is coupled to a gear reduction means for effectively transferring the driving power from the motor into the proper amount of torque and driving power for opening and closing a door or window wherein the requirement will change with the load being operated on by the system. A slip clutch may be coupled to the driven shaft of the reducing gear for generating a final driving force to effectively operate to accommodate the particular load being opened or closed by the system such as a door, window or the like. Alternatively, reducing gears will translate the output of the motor to provide the desired final drive and torque. This system allows a wide variety of driving forces to be employed for different closure devices and does not require high power consumption or generate excessive heat which may present safety problems. The slip clutch also allows "soft" starts and stops as an additional safety precaution and helps to prevent damage to the closure device or system at the end of travel during opening and closing. The system also allows minimal restriction during non-actuation of the system to allow manual movement of the door whenever desired. The mechanical system is small and light weight and may be mounted on a door or window or the frame thereof and includes an adjustable arm linkage for retrofit installation. The system may be easily and conveniently installed using bolts or tape to conveniently mount the system. The mechanical system is effectively controlled by control logic to effect proper operation of the mechanical system upon actuation from a remote location.

BRIEF DESCRIPTION OF THE DRAWINGS

These and other objects of the present invention will be seen more distinctly with reference to the following detailed description of the invention in conjunction with the drawings wherein.

DETAILED DESCRIPTION OF THE INVENTION

Figure 1:
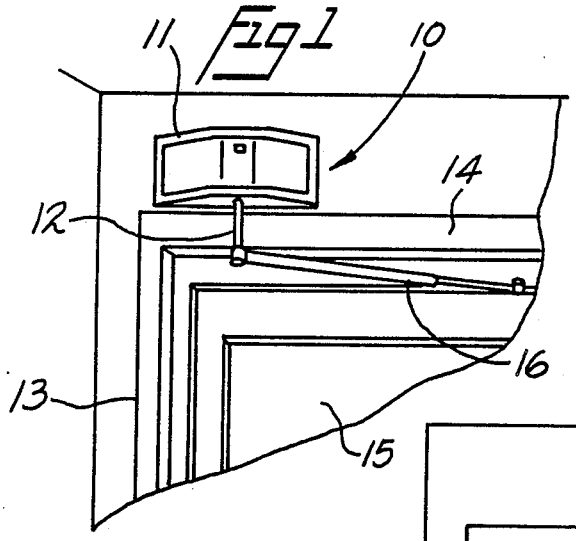
FIGS. 1 and 2 show alternative mounting positions for the automatic opening and closing device used in conjunction with a door.
Figure 2:
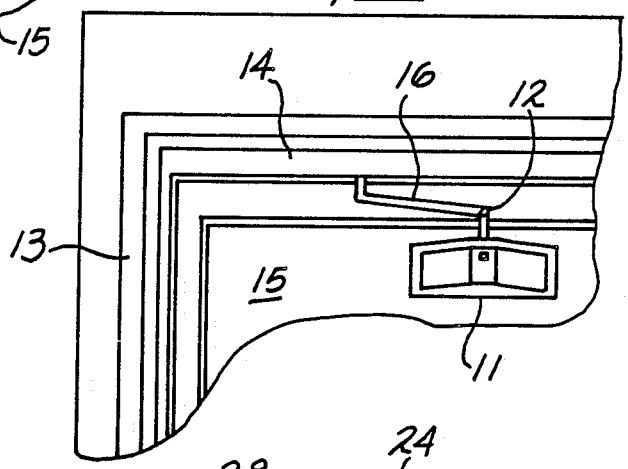

Turning now to the drawings, FIGS. 1 and 2 show several alternatives installations for the opening and closing device of the invention. The automatic opening and closing device 10 comprises a small, light weight one-piece enclosure 11 from which extends a shaft 12 which is rotatably driven in alternate directions to effect opening and closing of a door or other closure system with which the device is used. As seen in FIG. 1, a door way including door jamb 13 and header 14 supports a door 15 normally pivotable by means of hinges or the like supported on the door jamb 13. The driven shaft 12 of the opening and closing device 10 is coupled to the door 15 by means of a linkage arm 16 which extends from the shaft 12 a distance away from the door jamb 13 to be coupled to the door 15 at a location near the center and at the top thereof. The housing 11 may be suitably positioned on the wall surrounding the door frame or supported on the header 14 and/or door jamb 13 as desired. The housing 11 is suitably installed using screws or adhesive tapes or other suitable means to properly position and secure the housing 11 on or near the door frame.

Alternatively, as seen in FIG. 2, the housing 11 can be mounted on the door 15 itself. In this installation, the driven shaft 12 extends either upwardly to support the linkage arm assembly which is coupled to the header 14 or other suitable location in the vicinity thereof. In either of the installations as seen in FIGS. 1 and 2, the opening and closing device will operate to effectively open and close the door or other closure system upon actuation of the device from a remote location. It should also be recognized that various other installations are possible such as mounting the housing 11 within a door frame or other frame such that only the linkage arm extends from the frame to be coupled with the door or other closure system associated with the frame. This installation can be accomplished at new construction sites whereas the installations as shown in FIGS. 1 and 2 allow the device to be retrofit into an existing closure system.

Figure 3:
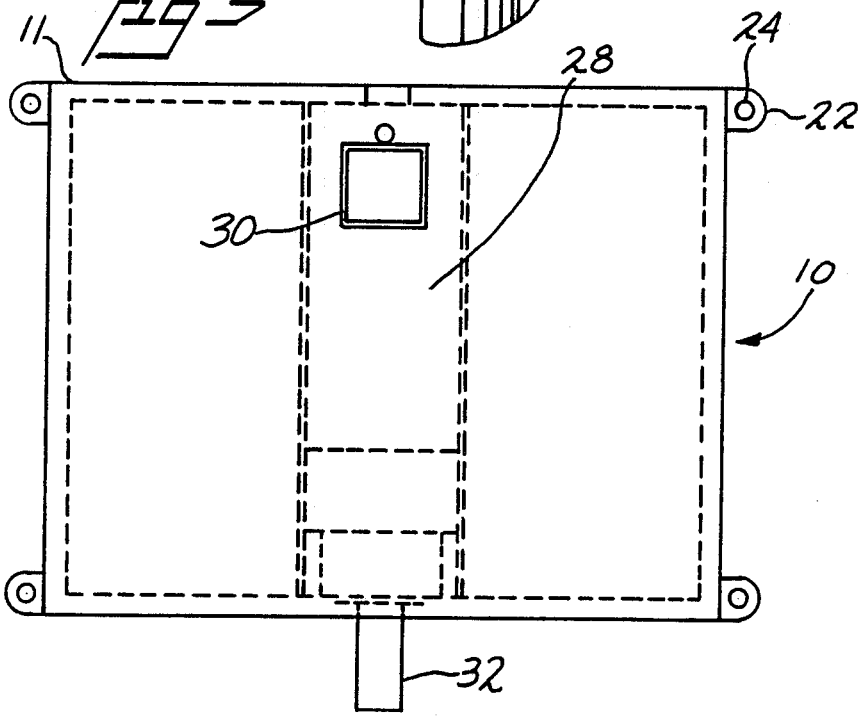
FIG. 3 is a front view of the housing of the opening and closing device.
Figure 4:
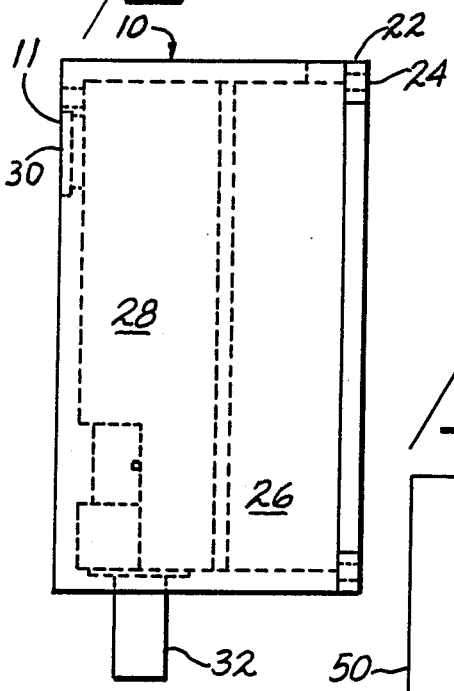
FIG. 4 is a side view of the device as shown in FIG. 3.
Figure 5:
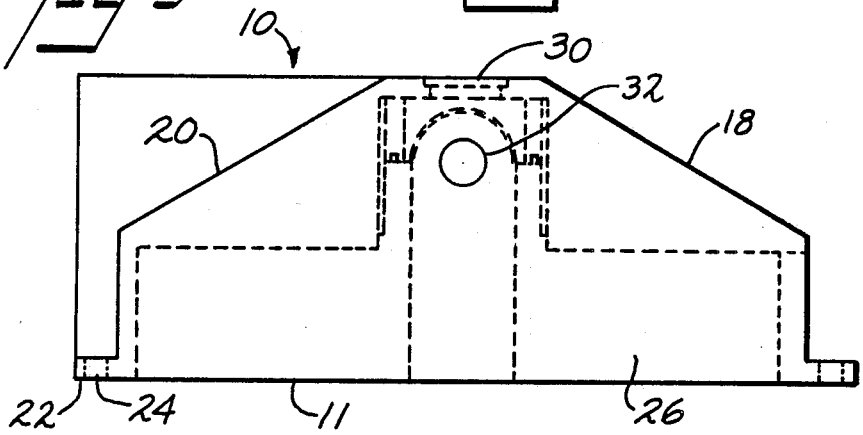
FIG. 5 is a end view of the device as shown in FIG. 3.

Turning now to FIGS. 3–5, the opening and closing device 10 is shown in more detail and comprises a low-profile housing 11 having general dimensions of approximately 8 inches in width, 6 inches in height and 5 inches in depth so as not to present a significant obstacle or problem for retrofit installation of the device. The low-profile housing also enables retrofitting of the device with an existing door or other closure system without presenting an unattractive appearance. As seen more distinctly in FIG. 5, the housing 11 may comprise two generally slanting front portions 18 and 20 so as to limit the extent that the device extends from the surface to which it is mounted. The housing 11 may include flanges 22 having apertures 24 therein through which a screw, bolt or suitable fastening means may be inserted and secured to the surface to which the housing 11 is mounted. The housing 11 includes a power supply such as one or more batteries 26 which may be laid flat in the housing 11 so as to reduce the bulk of the device 10. Alternatively, the device may be hard wired into an electrical system of a new construction site wherein the housing 11 may be mounted within the frame of a doorway or other area and be directly coupled to a source of AC current provided to residential or commercial cite. In the retrofit construction, the battery power supply operates to supply the necessary amount of DC current to motor 28 supported in housing 11. If the device is to be installed with new constructions so as to enable hard wiring thereof, the battery supply 28 may be diminished so as to provide only enough power for operation of the device over a limited period of time such as emergency situations.

In the preferred embodiment, the housing 11 further comprises a receiving window area 30 for the reception of infrared radiation emitted by an IR transmitter to be hereinafter described. Control circuitry will allow reception of infrared radiation to be transformed into operation of the opening and closing device 10 to suitably open or close the closure system upon actuation of the device from a remote location. The control circuitry is coupled to the motor 28, which along with other mechanical drive means will output a driving force by means of output shaft 32. A linkage arm to be described more fully hereinafter is coupled to the output via 32 to translate the driving force of the output shaft 32 to open or close the door appropriately.

Figure 6:
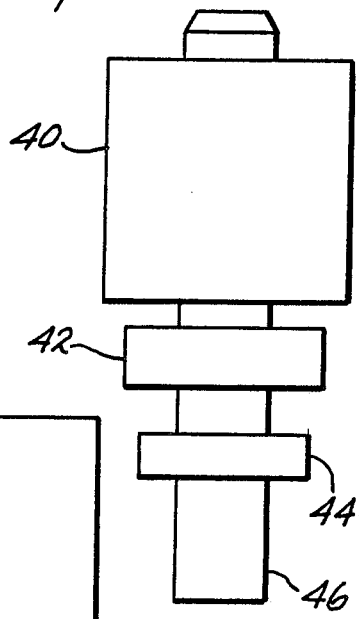
FIGS. 6 and 7 show alternate embodiments of the drive mechanism of the device.
Figure 7:
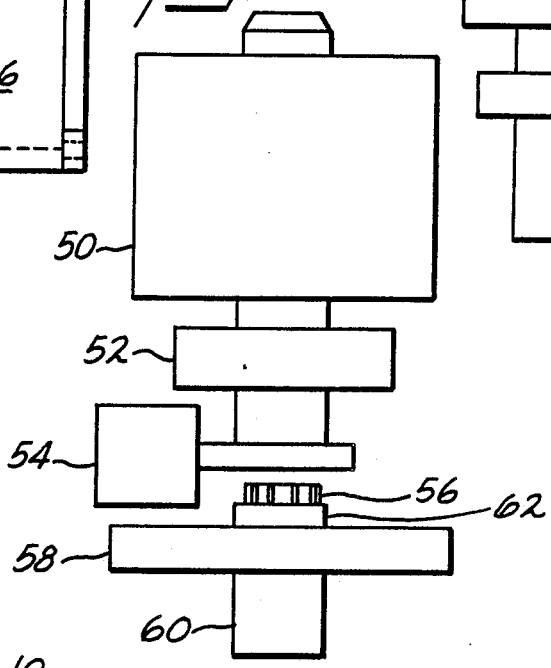

Turning now to FIGS. 6 and 7, alternate drive mechanisms for the device are shown in more detail. In FIG. 6, a reversible DC motor 40 which is preferably of relatively low-speed, drives an output shaft at a desired speed to thereby generate torque for opening and closing a door or the like. In a preferred embodiment, the DC motor may provide an output drive of 2750 RPM which will provide the desired amount of torque to open and close standard sized doors or other similar closure systems. The motor 40 is coupled to a reducing gear 42 having a high reduction gear ratio to provide the desired amount of torque for the particular closure system with which the device is to be used. In a preferred embodiment, the gear reduction ratio may be 500 to 1 resulting in an output drive and torque which is suitable to open and close standard sized doors and similar closure systems. If desired, a slip clutch 44 may be utilized coupling the reduction gear 42 to the output drive shaft 46 selectively. The slip clutch 44 may be actuated by means of a solenoid (not shown) and allows "soft" starts and stops during travel of the closure system while opening or closing. The slip clutch 44 will also act to prevent damage to the linkage assembly or motor of the device at the ends of travel of the closure system.

The construction of the driving mechanism, either with or without the slip clutch 44, is designed to provide "soft" starts and stops for the closure system. During starting or stopping of the closure system, a constant amount of torque should be applied by means of the driving mechanism until the closure system is up to a desired operating speed wherein it will continue until the end of travel at which the speed will be reduced smoothly until stopped. The slip clutch 44 may be utilized to effect this type of operation or in a configuration without the slip clutch, current limiting may be provided to reduce the output drive of the motor for a period of time after actuation to effect a "soft" start and similarly may be slowed at the end of travel of the closure system. After the closure system has been brought up to a normal operating speed, the motor will require less current to maintain such a speed which can similarly be effected by current limiting circuitry.

Turning now to FIG. 7, an alternate embodiment of the driving mechanism is shown. In this embodiment, a reversible DC motor 50, similar to that described with reference to FIG. 6 is utilized. A reducing gear 52 is again utilized to provide the desired amount of torque and final driving speed for the output shaft 62. The output of the reducing gear 52 is coupled to a solenoid gear engaging mechanism 54 which when energized will couple the output shaft of the reduction gearing to the output shaft 62 at gear 56. An encoder 58 such as an optical encoder may be coupled to the output drive shaft 60 so as to monitor rotation of the shaft 60 during operation. In this manner, the exact location of the closure system to which the opening and closing device is utilized can be monitored such that selective variable operation of the closure system can be effected. In this embodiment, the control circuitry to be hereinafter described may comprise position information and direction of travel information based upon signals received from the encoder 58 such that the closure system can be opened or closed only a selected amount and the end of travel can be effectively monitored to prevent damage to the linkage assembly or motor of the device.

In the preferred embodiment, it is desirable to provide a final drive of 0.2 to 0.3 RPM to provide quiet and constant motion of the closure assembly wherein a standard sized door may be opened from a closed position in an average of five seconds per 90 degrees of rotation of the door. It should also be seen that the drive mechanisms as shown in FIGS. 6 and 7, either with slip clutch or without allow a closure system to be operated manually without substantial restriction to manual movement of the door or other closure system.

Figure 8:
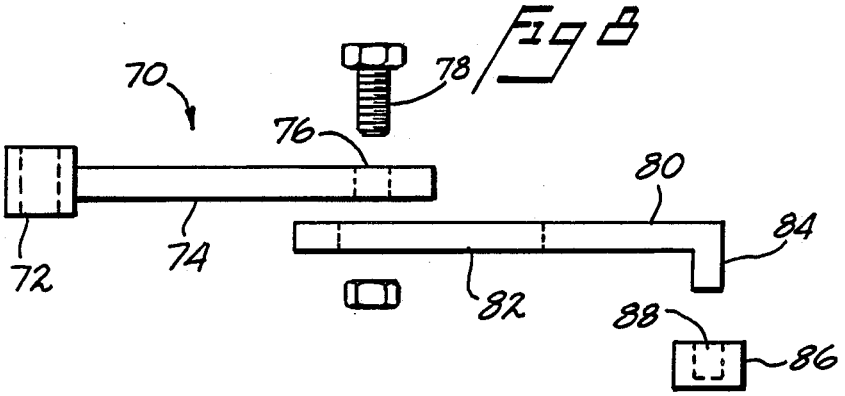
FIGS. 8, 9 and 10 show various linkage arm assemblies which may be used with the device.

The housing and driving mechanism which may be mounted on a stationery surface in the vicinity of a closure system or on the closure system such as a door or window itself is then coupled to effect opening and closing of the closure systems by means of an adjustable arm linkage assembly to be described with reference to FIGS. 8–10. As seen in FIG. 8, one embodiment of an adjustable arm linkage as shown at 70 comprises a head portion 72 having an aperture therein so as to be coupled with the output drive shaft of the driving mechanism of the device. The head portion 72 may be coupled to the output drive shaft by any suitable securing means such that the linkage arm is securely coupled to the output drive shaft for rotation therewith. A first arm portion 74 is provided and has an aperture 76 extending therethrough at its outer periphery through which a coupling means such as bolt 78 may be inserted for securing to a second arm portion 80 having a longitudinal slot 82 therein. The slot 82 allows variable positioning of the second arm portion 80 to the first arm portion 74 such that the linkage arm assembly 70 may be suitably coupled to a door, window or the like at the desired location regardless of the installation position of the housing. The second arm portion 80 includes an extending peg or rod portion 84 which is adapted to be received in a track portion 86 having a notch 88 therein which is mounted on the closure system o frame thereof depending upon the installation method utilized. In any event, the linkage arm assembly 70 should extend to approximately the center of the closure system such as a door, window or the like wherein the torque provided by the driving mechanism will operate to move the weight of the closure system for opening or closing thereof.

The linkage arm assembly 70 may be constructed of a relatively lightweight plastic material which will bend upon actuation of the device thereby enhancing the "slow" start and stops of the closure system as well as effectively translating the torque provided by the driving mechanism to the closure system.

Figure 9:
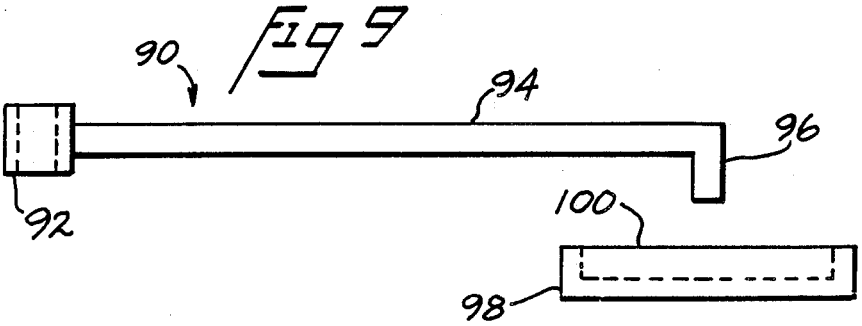

In an alternate embodiment as seen in FIG. 9, a one-piece linkage arm assembly 90 comprises a head portion 92 similar to that previously described along with a first arm portion 94 having a predetermined length. An extending peg or rod portion 96 is formed on the outer periphery of the arm 94 which is adapted to coact with a track member 98 having a longitudinally extending groove 100 formed therein. The track member 98 is positioned such that the peg 96 will be inserted into the groove 100 to be movable in the confines thereof. Upon actuation of the opening and closing device, the peg 96 will move within the groove 100 until one end thereof is reached or friction between the peg 96 and groove 100 prevents further movement. In this way, the arm linkage assembly 90 is automatically adjustable over the extent of the track portion 98 wherein after relative movement of the peg 96 within groove 100 has stopped the torque provided by the driving mechanism will be transferred via the linkage arm 94 to the closure system.

Figure 10:
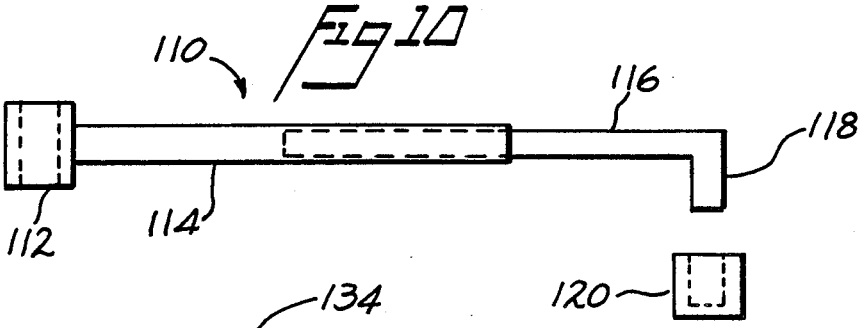

Another embodiment of the linkage arm assembly is seen in FIG. 10, wherein the linkage arm 110 comprises a head portion 112 along with a first arm portion 114 being of hollow construction. A second arm portion 116 is adapted to be telescopically slidable in the first portion 114 for relative movement therebetween. The second arm portion 116 includes an extending peg portion 118 adapted to be received in a track member 120 as previously described. In this embodiment, the linkage arm assembly 110 is automatically adjustable wherein the first arm portion 114 and second arm portion 116 will slide relative to one another upon actuation of the device until friction created by the rotational movement of the first arm portion 114 relative to the second arm portion 116 will prevent further movement therebetween. Upon stoppage of relative movement between the first and second arm portions 114 and 116, the torque generated by the drive mechanism will be transferred to the second arm portion 116 and subsequently to the closure system in this type of installation. Again the linkage arms may be manufactured of a rigid yet resilient plastic material which will bend upon actuation of the driving mechanism to effectively translate the torque generated thereby to the closure system and to facilitate "soft" starts and stops with the device.

Figure 11:
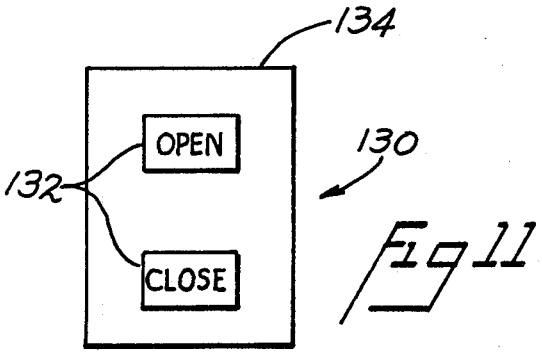
FIG. 11 shows a transmitting device for use with the invention to effect operation of the opening and closing device.

Turning now to FIG. 11, a simplified transmitting device is shown comprising a remote hand-held transmitter 130 having a plurality of control switches 132 thereon. In its simplest form, the transmitter may comprise two switches to effect opening or closing of the closure system as shown. Alternatively, other control functions could be provided on the transmitter to enable variable operation of the opening and closing device from a remote location. In the preferred form, the transmitter constitutes an infrared remote control having a window 134 on an edge thereof through which infrared radiation is transmitted. A plurality of discrete channels emitting discrete frequencies are provided such that the transmitter and receiver at the opening and closing device can be tuned to operate only on a selected channel or frequency. In this way, the opening and closing device can be tuned to prevent accidental operation thereof and to allow a plurality of systems to be operated in the same vicinity. For example, the remote control transmitter 130 could be provided with 512 discrete channels or frequencies or any factor thereof. Although the preferred form utilizes infrared signals to control function of the device, it should be recognized that these signals are directional and necessitate line of sight contact between the remote transmitter and receiver. Alternatively, radio signals or any other suitable information signals may be provided to effect operation of the device. It should also be recognized that the hand-held remote transmitter is only one way of actuating the device and other methods may be utilized as well. For example, remote sensing devices such as temperature, heat, smoke, moisture sensors or the like may be used to monitor physical conditions in an area and to transmit control signals to the opening and closing device if particular conditions arise. Thus, a temperature or smoke detector could be utilized to detect the presence of fire and to transmit an opening or closing control signal to the device.

Figure 12:
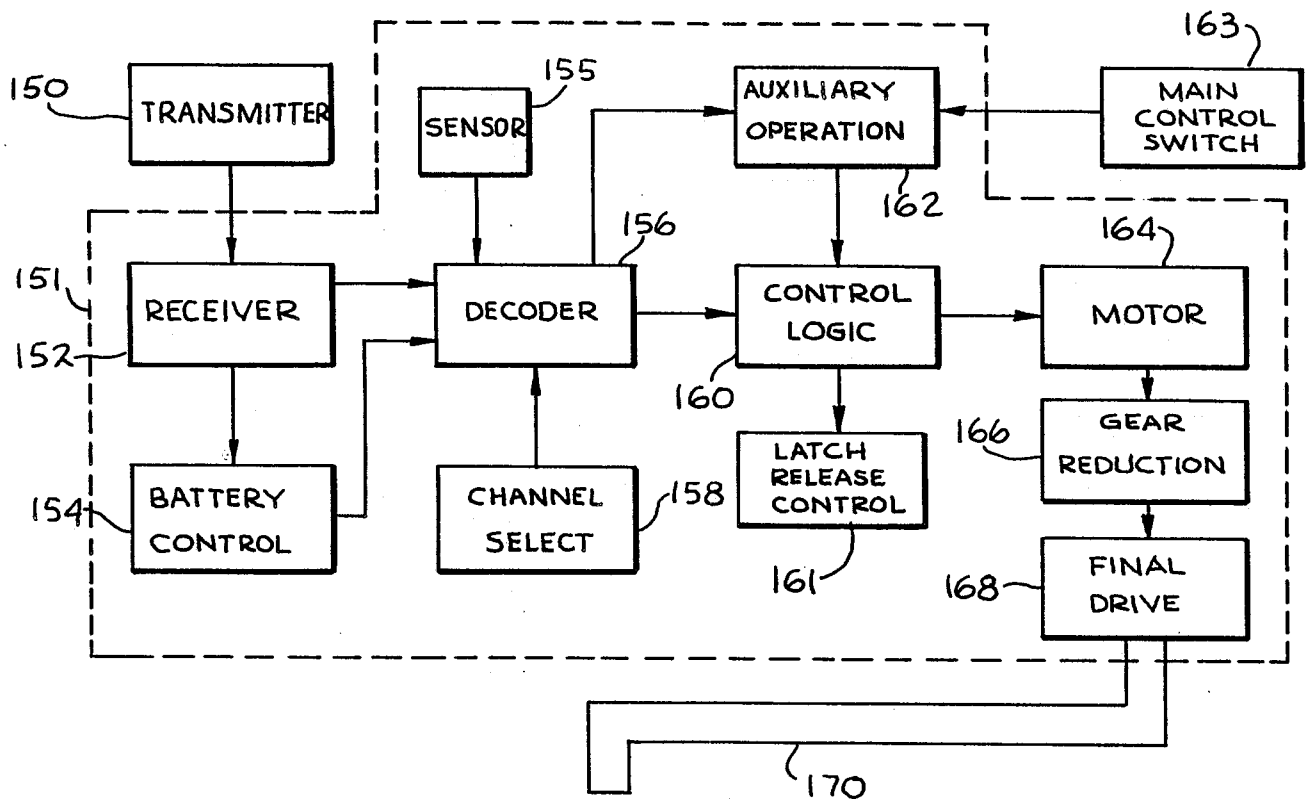
FIG. 12 is a block diagram of the components and control circuit of the opening and closing system.

Turning now to FIG. 12, the operation of the device and the control circuitry associated therewith will be described in more detail. As seen in FIG. 12, a remote transmitter 150 is used to send signals to a receiver 152 associated with the device as indicated by line 151. Upon reception of control signals by receiver 152, a battery control circuit 154 is initialized to couple the remaining portions of the control circuit to receiver 152. As mentioned previously, the power supply may be a battery supply wherein conservation of the available battery power is necessary to extend the useful life of the device. By automatically placing the battery in a stand-by mode within the circuit when the device is not in use, the battery power can be conserved to extend the life thereof. Upon actuation of the device, the battery is placed in an operational mode wherein the full power thereof will be available to the motor and circuitry. For example, the battery supply of the device may comprise a plurality of rechargeable nickel-cadmium energy cells which when taken out of the circuit in the manner of the present invention will enable approximately one year of battery life before recharging of the batteries is necessary. A recharging circuit (not shown) may be incorporated easily recharge the batteries when necessary. By extending the useful life of the batteries in this manner, the device may be used for an average of 10,000, 90 degree full motion opening or closing operations before recharging of the batteries is necessary.

After coupling the power supply to the decoder 156, the received signals will be transformed into control signals in conjunction with a channel select circuit 158 to supply these signals to control logic 160. The control logic 160 may be discrete logic or a microprocessor based system having programming information stored therewith. As mentioned previously, the control logic 160 may simply comprise opening or closing information to effect operation of the motor 164 in the desired direction or may include other information such as the relative position of the closure system or similar information for selective and variable control of the system. As previously described, the motor 164 may be coupled to gear reduction means 166 to provide a final drive 168 for output shaft 170.

The control logic 160 may also be coupled to a latch release control circuit 161 to develop a signal enabling unlatching of a door, window or the like. The particular mechanism to effect release of a latch is not critical and may comprise an electrical release mechanisn similar to that found in U.S. Pat. Nos. 3,804,442, 4,529,234 or the like. The control circuit 161 will provide an appropriate signal to initiate release of the latch upon actuation of the device.

There is also provided an auxiliary operation circuit 162 coupled to the control logic 160 to effect operation of the opening and closing device by means other than the transmitter 150 or similar transmitting means. In one embodiment, the auxiliary operation 162 may be initiated upon reception of an override control signal generated at the location of the device itself. As an example, a sensing device 155 can be utilized to generate an override signal which can be coupled to decoder 156 which will transmit this control information to the auxiliary operation circuit 162 to effect the desired opening or closing of the closure system. Alternatively, the sensor 155 could be directly coupled to auxiliary operation circuit 162 for operation thereof. Auxiliary operation of the device may be desired when an emergency situation arises such that the device can automatically be operated based upon the occurrence of an override control signal.

Alternatively, in a hard wired embodiment of the invention, auxiliary operation may be effected by a centralized control means coupled to one or more of the devices. For example, a main control switch 163 could be physically coupled to the device for selective operation thereof which could be tied into the emergency system of the house or building in which the opening and closing device(s) are used. Alternatively, a signal may be provided on the electrical line coupling power to the opening and closing device as a modulated signal for selective operation of the device.

It should be recognized that the remote controlled opening and closing device of the invention achieves the objectives as set forth to provide an efficient, cost-effective and simply installed and used system for automatically opening and closing a door, window or the like. The system can be retrofitted into an existing construction or incorporated into new construction, and includes battery power supply or back up power supply for operation regardless of existing conditions such as emergency situations.

It will be understood by those skilled in the art that the foregoing description is in terms preferred embodiments of the present changes or modifications may be made without departing from the spirit and scope of the invention as set forth in the appended claims.

What is claimed is:

1. A selectively operable automatic opening and closing device for use with a closure system comprising, a reversible motor means having a rotatably driven output shaft to generate a driving force for movement of said closure system, at least a battery power supply means to provide electrical energy for operation of said device, a drive train coupled to said output shaft including reducing gear means and slip clutch means wherein said reducing gear means has a high reduction gear ratio to supply a desired amount of torque and said slip clutch means will slip during initial operation of said motor means to provide soft starting and stopping characteristics, an adjustable linkage means coupled to said drive train to translate said driving force to said closure system, control circuit means coupled to said motor means to actuate operation of said motor means upon reception of actuation signals, receiving means coupled to said control circuit means for reception of actuation signals generated from a remote transmitter which is adapted to transmit a plurality of control signals.

2. An automatic opening and closing device as in claim 1, further comprising, encoding means coupled to said drive shaft to monitor the rotation and direction of rotation of said shaft to provide position information of said closure system to said control circuitry for variable operation of said motor means.

3. An automatic opening and closing device as in claim 1, wherein, said control circuit means includes means to predetermine the speed of said output drive shaft and is selectively controlled by current limiting to provide soft starts and stops during opening or closing of said closure system.

4. An automatic opening and closing device as in claim 1, wherein, said battery power supply means is selectively coupled to said control circuitry upon reception of signals emitted by said transmitter at a remote location so as to conserve the power stored in said battery supply means.

5. An automatic opening and closing device as in claim 1, wherein, said device is coupled to a source of electrical power in addition to said battery power supply means to provide power for said control circuitry and said motor means and said battery power supply means is a back-up battery supply means to be utilized for operation of said device upon failure of said source of electrical power.

6. An automatic opening and closing device as in claim 1, further comprising, a latch release control means coupled to said control circuitry to provide a signal which may be utilized to effect release of a latch means associated with said closure system.

7. An automatic opening and closing device as in claim 1, further comprising, an auxiliary operation circuit means to effect operation of said device regardless of reception of signals emitted by said transmitter.

8. An automatic opening and closing device as in claim 7, wherein, said auxiliary operation circuit means is initiated by signals initiated by signals generated by a sensing device included in said opening and closing device such that upon sensing of a predetermined physical condition, actuation of said opening and closing device will be initiated.

9. An automatic opening and closing device as in claim 7, wherein, said auxiliary operation circuit means is initiated by a main control switch means coupled to said device for selective operation thereof.

10. An automatic opening and closing device as in claim 1, wherein, said linkage means comprises a first arm portion coupled to said drive shaft, a second arm portion adjustably coupled to said first arm portion at one end thereof and to said closure system at the other end thereof.

11. An automatic opening and closing device as in claim 1, wherein, said linkage means comprises a first arm portion having means at said other end thereof which coacts with a track means having a longitudinal slot therein to provide limited respective movement between said arm and said track means upon actuation of said opening and closing device.

12. An automatic opening and closing device as in claim 1, wherein, said linkage means comprises a first arm portion coupled to said drive shaft, a second arm portion telescopically slidable within said first arm portion at one end thereof and having a means at the other end thereof to secure said second arm portion in the vicinity of said closure system wherein relative movement between first and second arm portions is enabled upon actuation of said opening and closing to provide an automatically adjustable linkage arm assembly.

13. An automatic opening and closing device as in claim 1, wherein, said remote transmitter comprises a hand-held remote control transmitter.

14. An automatic opening and closing device as in claim 1, wherein, said remote transmitter comprises a remote environmental condition sensing device which will transmit signals to said receiving means upon the occurrence of a predetermined physical condition.

15. An automatic opening and closing device as in claim 1 wherein the door can be open and closed manually because of the slipping of the slip clutch means.

* * * * *